US006557464B2

(12) United States Patent
Käser et al.

(10) Patent No.: US 6,557,464 B2
(45) Date of Patent: May 6, 2003

(54) NINE-CYLINDER SATELLITE PRINTING UNIT

(75) Inventors: Wolfgang Käser, Mertingen (DE); Rainer Burger, Augsburg (DE); Norbert Dylla, Stadtbergen (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 10/103,345

(22) Filed: Mar. 21, 2002

(65) Prior Publication Data

US 2002/0134262 A1 Sep. 26, 2002

(30) Foreign Application Priority Data

Mar. 23, 2001 (DE) ..... 101 14 347

(51) Int. Cl.[7] ..... B41F 13/14; B41F 7/10

(52) U.S. Cl. ..... 101/143; 101/177; 101/135; 101/152; 101/221

(58) Field of Search ..... ; 101/142, 136, 101/135, 177, 220, 221, 143, 152; B41F 13/14, 7/10

(56) References Cited

U.S. PATENT DOCUMENTS

| | | | | |
|---|---|---|---|---|
| 4,250,809 A | * | 2/1981 | Pullen | 101/177 |
| 4,369,705 A | * | 1/1983 | Gelinas | 101/177 |
| 5,179,899 A | * | 1/1993 | Burger et al. | 101/181 |
| 6,363,848 B1 | * | 4/2002 | Weschenfelder | 101/138 |
| 6,408,746 B1 | * | 6/2002 | Weschenfelder | 15/167.1 |

FOREIGN PATENT DOCUMENTS

| | | | | |
|---|---|---|---|---|
| DE | 39 39 432 | | 6/1991 | |
| DE | 198 33 470 | | 2/2000 | |
| FR | 1 284 623 | | 1/1961 | |
| JP | 06255073 A | * | 9/1994 | B41F/7/10 |
| JP | 09109360 | | 4/1997 | |

OTHER PUBLICATIONS

H. Teschner, Offset druck technik, p. 10/32, (1989).

* cited by examiner

*Primary Examiner*—Andrew H. Hirshfeld
*Assistant Examiner*—Andrea A. Hence
(74) *Attorney, Agent, or Firm*—Cohen, Pontani, Lieberman & Pavane

(57) ABSTRACT

A nine-cylinder satellite printing unit includes printing stations having a first, second, third and fourth transfer cylinder which a web passes through. The transfer cylinders are capable of being stopped when the printing assembly is switched off. A distance between each of the first and second transfer cylinders, the second and third transfer cylinders, and the third and fourth transfer cylinder is shorter than the distance between the first and fourth transfer cylinder. A guide roller keeps a supplied portion of the web away from the first transfer cylinder and another guide roller keeps a discharged portion web away from the fourth transfer cylinder when the first and fourth printing cylinders are respectively in print thrown-off positions.

10 Claims, 1 Drawing Sheet

NINE-CYLINDER SATELLITE PRINTING UNIT

BACKGROUND OF THE INVENTION

1. Field of the Invention

The present invention relates to a nine-cylinder satellite printing unit having four printing assemblies arranged on a satellite cylinder, each of the printing assemblies containing a form cylinder and a transfer cylinder.

2. Description of the Related Art

Two nine-cylinder satellite printing units which are arranged one above the other in a vertical form of construction are shown in the Manual by Helmut Teschner: Offsetdrucktechnik [Offset Printing Technology] 10th edition, 70736 Fellback: Fachschriften-Verlag, 1997, page 10/32, in FIG. 10. In this assembly, a web is first printed in 4 colors on one side in the lower printing unit and is subsequently fed to the upper printing unit where the web is likewise printed in 4 colors on the reverse side in a second printing. The supply and discharge of the web to and from the satellite cylinder occurs in such a way that the web partially loops around the respective transfer cylinder which is placed at the inflow and outflow and which is in the print throw-off position. The disadvantage of this prior art device is that the transfer cylinder cannot be stopped for a dynamic plate change. The form cylinder and transfer cylinder of each printing assembly of the four printing assemblies of the nine-cylinder satellite printing unit are usually drive-connected mechanically via spur wheels, so that a dynamic plate change is not possible on the printing assemblies arranged on both sides of the web inflow and outflow.

SUMMARY OF THE INVENTION

It is an object of the present invention to provide a nine-cylinder satellite printing unit in which a transfer cylinder of a printing assembly may be stopped when a printing assembly is to be switched off for a dynamic plate change.

The object of the present invention is achieved by a nine-cylinder satellite printing unit for receiving and discharging a web to be printed on, wherein a supplied portion of the web is supplied substantially vertically and a discharged portion of the web is discharged substantially vertically. The nine-cylinder satellite printing unit includes a satellite cylinder and first, second, third, and fourth transfer cylinders positioned around the satellite cylinder which form respective printing stations. The first and fourth transfer cylinders are movable between a thrown-on and a thrown-off position relative to the satellite cylinder. Furthermore, a distance between each of the first and second transfer cylinders, the second and third transfer cylinders, and the third and fourth transfer cylinders is smaller than a distance between the first and fourth transfer cylinders. A satellite washing device is arranged between the supplied portion of the web and the discharged portion of the web. An input guide roller proximate the first transfer cylinder guides the supplied portion of the web to the satellite cylinder such that the supplied portion of the web is maintained off of the first transfer cylinder when the first transfer cylinder is in the thrown-off position and an output guide roller proximate the fourth transfer cylinder guides the discharged portion of the web away from the satellite cylinder such that the discharged portion of the web is maintained off of the fourth transfer cylinder when the fourth transfer cylinder is in the thrown-off position. The proposed arrangement of the transfer cylinders of the printing unit and placement of guide rollers for guiding a web run allow the transfer cylinders to be thrown off when the web is running while preserving a satellite washing device, if appropriate.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The drawing is a schematic side view showing two nine-cylinder satellite printing units arranged one above the other and the relative positions of the printing assemblies according to the present invention.

DETAILED DESCRIPTION OF THE PRESENTLY PREFERRED EMBODIMENTS

Figure 1:
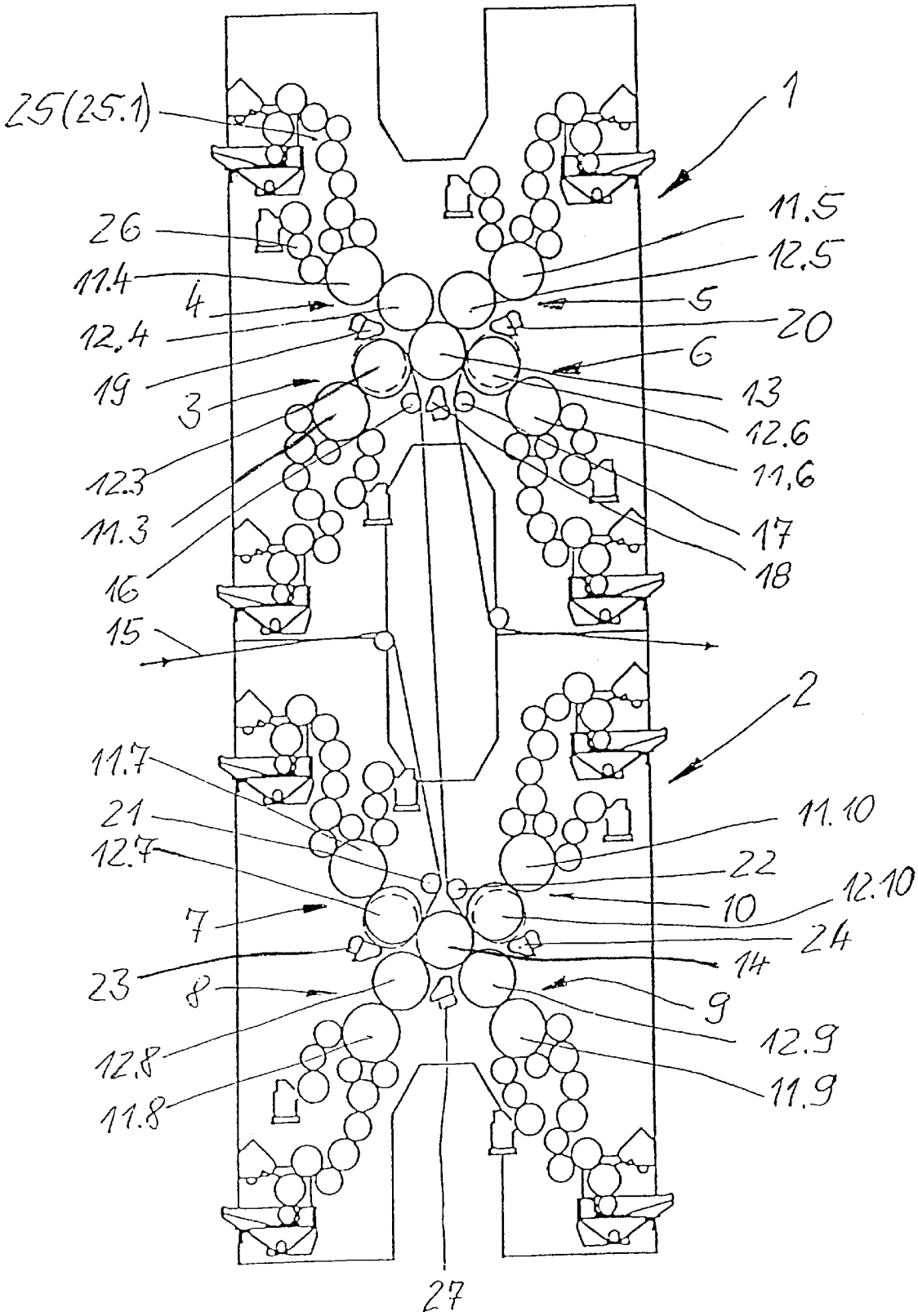

In the drawing, a first upper nine-cylinder satellite printing unit 1 is arranged above a second nine-cylinder satellite printing unit 2. The first nine-cylinder satellite printing unit 1 includes four printing assemblies 3, 4, 5, 6. Likewise, the second nine-cylinder satellite printing unit 2 includes four printing assemblies 7, 8, 9, 10. Each printing assembly 3–10 includes a form cylinder 11.3 to 11.10 (individually referred to as the first through eighth form cylinder 11.3 to 11.10) and a transfer cylinder 12.3 to 12.10 (individually referred to as the first through eighth transfer cylinder 12.3 to 12.10). In the reference characters of the form and transfer cylinders, the numeral after the point indicates in each case the reference numeral of the associated printing assembly 3–10. Each of the first and second nine-cylinder satellite printing unit 1, 2 has a satellite cylinder 13, 14, with which the associated printing assemblies 3 to 6 and 7 to 10 respectively cooperate and form printing stations.

The first through fourth transfer cylinders 12.3–12.6 are arranged on the satellite cylinder 13 such that the distances between the first and second transfer cylinders 12.3, 12.4, second and third transfer cylinders 12.4, 12.5, and the third and fourth transfer cylinders 12.5, 12.6 are short compared to a large free circumferential region of the satellite cylinder 13 between the first and the fourth transfer cylinder 12.3, 12.6. A web 15 is supplied to and discharged from the first nine-cylinder satellite printing unit 1 in this region between the first and the fourth transfer cylinder 12.3, 12.6. In the drawing, the web 15 is supplied to the first nine-cylinder satellite printing unit 1 via a guide roller 16 and the web 15 is discharged from the first nine-cylinder satellite printing unit 1 via a guide roller 17. The guide roller 16 is positioned such that the web 15 does not touch the first transfer cylinder 12.3, in the region of which it is guided, when the first transfer cylinder 12.3 is in the print throw-off position. The print throw-off position of the first transfer cylinder 12.3 is depicted by broken lines. Similarly, the guide roller 17 is positioned such that the web 15 to be discharged from the first nine-cylinder satellite printing unit 1 is guided away from the fourth transfer cylinder 12.6 such that the fourth transfer cylinder 12.6 is not touched by the web 15 as it is being discharged when the fourth transfer cylinder 12.6 is located in the print throw-off position (the region of the fourth transfer cylinder 12.6 is the last to be passed by the web). The first nine-cylinder satellite printing unit 1 further includes a rubber-blanket washing device 19 capable of being thrown onto the first and second transfer cylinder 12.3, 12.4 and another rubber-blanket washing device 20 capable of being thrown onto the third and fourth transfer cylinder 12.5, 12.6.

The web 15 is supplied to the second nine-cylinder satellite printing unit 2 in the region between the fifth and eighth transfer cylinder 12.7, 12.10. Two guide rollers 21, 22 are arranged in this region. The guide roller 21 is positioned such that the web 15 does not touch the fifth transfer cylinder 12.7, the region of which is the first to be passed by it, when the fifth transfer cylinder is in the print throw-off position of said transfer cylinder. The guide roller 22 is positioned such that the web 15 is kept away from the eighth transfer cylinder 12.10, the region of which is the last to be passed by the web 15, as it is being discharged from the second nine-cylinder satellite printing unit 2 such that the eighth transfer cylinder 12.10 is not touched when it is in its print throw-off position. The second nine-cylinder satellite printing unit 2 includes a rubber-blanket washing device 23 capable of being thrown onto the fifth and sixth transfer cylinder 12.7, 12.8 and a rubber-blanket washing device 24 capable of being thrown onto the seventh and eighth transfer cylinder 12.9 and 12.10. The print throw-off positions of the fifth and eighth transfer cylinder 12.7, 12.10 are in each case depicted by broken lines.

The sixth and seventh transfer cylinder 12.8, 12.9 are spaced from one another in such a way that a satellite washing device 27 is accommodated between them. On the other hand, if the satellite washing device 27 is dispensed with, the distance between the sixth and seventh transfer cylinder 12.8, 12.9 affords access for a manual cleaning of the satellite cylinder 14.

The web 15 is first supplied substantially vertically to the second nine-cylinder satellite printing unit 2. The term "substantially vertically", as used in the specification and claims, means that the web is guided from the top or bottom of the printing unit 1, 2 to the satellite cylinder 13, 14. In the second nine-cylinder satellite printing unit 2, the web 15 is guided on to the satellite cylinder 14 via the guide roller 21 and passes in succession the printing stations formed by the fifth, sixth, seventh and eighth transfer cylinders 12.7, 12.8, 12.9, 12.10 when they are in the printing thrown-on position on the satellite cylinder 14. In this case, the web 15 is printed in four colors on one side. The web 15 is subsequently discharged from the second nine-cylinder satellite printing unit 2 via the guide roller 22 and is supplied approximately vertically to the first nine-cylinder satellite printing unit 1. It is guided first via the guide roller 16 and thereafter by lying on the satellite cylinder 13, at the same time passing in succession the printing stations which the first, second, third and fourth transfer cylinders 12.3, 12.4, 12.5 and 12.6 form with the satellite cylinder 13 when they are thrown on the satellite cylinder 13. In this case, the other side of the web 15 is printed in four colors in verso printing. The web 15 is subsequently discharged from the first nine-cylinder satellite printing unit 1, being guided via the guide roller 17.

A dynamic plate change is possible in each printing assembly 3 to 10 in the first and second nine-cylinder satellite printing units 1, 2. That is, a printing-plate change in which, for this purpose, a printing assembly, for example the printing assembly 6, is switched off and stopped, while the further printing assemblies, for example the printing assemblies 3 to 5 of the first nine-cylinder satellite printing unit 1, continue to print the web 15. In this case, on the printing assembly in which the printing-plate change is carried out, both the form cylinder 11.3 to 11.10 and the transfer cylinder 12.3 to 12.10 can be stopped.

To wash the satellite cylinder 13 of the first nine-cylinder satellite printing unit 1, a satellite washing device 18 is thrown onto said satellite cylinder 13. The satellite cylinder 14 may be washed by the satellite washing device 27. The transfer cylinders 12.3 to 12.10 are capable of being washed by the associated rubber-blanket washing devices 19, 20, 23, 24.

The first and second nine-cylinder satellite printing units 1, 2 of the exemplary embodiment operate according to the offset printing method. An inking assembly 24 and a dampening assembly 25 are numbered only on the second printing assembly 4 as being representative of the printing assemblies 3 to 10. The first and second nine-cylinder satellite printing units 1, 2 may also operate according to another printing method such as, for example, the indirect intaglio printing method. In this case, an intaglio inking assembly 25.1 is arranged (indicated in brackets in the drawing) on the form cylinder 11.3 to 11.10 and the dampening assembly 26 may be dispensed with.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A nine-cylinder satellite printing unit for receiving and discharging a web to be printed on, wherein a supplied portion of the web is supplied substantially vertically and a discharged portion of the web is discharged substantially vertically, said nine-cylinder satellite printing unit comprising:

a satellite cylinder;

first, second, third, and fourth transfer cylinders positioned around said satellite cylinder and forming respective printing stations, at least said first and fourth transfer cylinders being movable between a thrown-on and a thrown-off position relative to said satellite cylinder, a distance between each of said first and second transfer cylinders, said second and third transfer cylinders, and said third and fourth transfer cylinders being smaller than a distance between said first and fourth transfer cylinders;

a satellite washing device between the supplied portion of the web and the discharged portion of the web; and an input guide roller proximate said first transfer cylinder for guiding the supplied portion of the web to the satellite cylinder such that the supplied portion of the web is maintained off of said first transfer cylinder when said first transfer cylinder is in said thrown-off position and an output guide roller proximate said fourth transfer cylinder for guiding the discharged portion of the web away from said satellite cylinder such that the discharged portion of the web is maintained off of said fourth transfer cylinder when said fourth transfer cylinder is in said thrown-off position.

2. The nine-cylinder printing unit of claim 1, further comprising a rubber-blanket washing device for said first and second transfer cylinders and another rubber blanket washing device for the third and fourth transfer cylinders.

3. The nine-cylinder satellite printing unit of claim 1, wherein said nine-cylinder satellite printing unit comprises an offset printing machine.

4. The nine-cylinder satellite printing unit of claim 1, wherein said nine-cylinder satellite printing unit comprises an indirect intaglio printing machine.

5. A nine-cylinder satellite printing unit for receiving and discharging a web to be printed on, wherein a supplied portion of the web is supplied substantially vertically and a discharged portion of the web is discharged substantially vertically, said nine-cylinder satellite printing unit comprising:

a satellite cylinder;

first, second, third, and fourth transfer cylinders positioned around said satellite cylinder and forming respective printing stations, at least said first and fourth transfer cylinders being movable between a thrown-on and a thrown-off position relative to said satellite cylinder, a distance between each of said first and second transfer cylinders, said second and third transfer cylinders, and said third and fourth transfer cylinders being smaller than a distance between said first and fourth transfer cylinders; and an input guide roller proximate said first transfer cylinder for guiding the supplied portion of the web to the satellite cylinder such that the supplied portion of the web is maintained off of said first transfer cylinder when said first transfer cylinder is in said thrown-off position and an output guide roller proximate said fourth transfer cylinder for guiding the discharged portion of the web away from said satellite cylinder such that the discharged portion of the web is maintained off of said fourth transfer cylinder when said fourth transfer cylinder is in said thrown-off position.

6. The nine-cylinder satellite printing unit of claim 5, wherein said third and fourth transfer cylinders are spaced for allowing access for washing said satellite cylinder.

7. The nine-cylinder satellite printing unit of claim 6, further comprising a satellite washing device between said third and fourth transfer cylinders.

8. The nine-cylinder satellite printing unit of claim 5, further comprising a rubber-blanket washing device for said first and second transfer cylinders and another rubber blanket washing device for the third and fourth transfer cylinders.

9. The nine-cylinder satellite printing unit of claim 5, wherein said nine-cylinder satellite printing unit comprises an offset printing machine.

10. The nine-cylinder satellite printing unit of claim 5, wherein said nine-cylinder satellite printing unit comprises an indirect intaglio printing machine.

* * * * *